US006021699A

United States Patent [19]

Caspar

[11] Patent Number: 6,021,699

[45] Date of Patent: Feb. 8, 2000

[54] WATERJET CUTTING HEAD

[76] Inventor: Roman C. Caspar, 21 Margaret Ann, Beaconsfield, Quebec, Canada, H9W 5N7

[21] Appl. No.: 09/153,608

[22] Filed: Sep. 15, 1998

[30] Foreign Application Priority Data

Jul. 23, 1998 [CA] Canada ..... 2243771

[51] Int. Cl.[7] ..... B26F 1/26

[52] U.S. Cl. ..... 83/177; 83/425; 83/953

[58] Field of Search ..... 83/53, 177, 409, 83/422, 425, 425.1, 433, 434, 464, 451, 100, 102.1, 953; 451/80, 75, 40

[56] References Cited

U.S. PATENT DOCUMENTS

| | | | |
|---|---|---|---|
| 2,003,404 | 6/1935 | Valentine | 83/100 |
| 3,234,836 | 2/1966 | Buff | 83/422 |
| 3,495,492 | 2/1970 | Gerber et al. | 83/451 X |
| 3,835,747 | 9/1974 | Bystron | 83/422 |
| 3,877,334 | 4/1975 | Gerber | 83/53 X |
| 3,996,825 | 12/1976 | Terry | 83/53 |
| 4,312,254 | 1/1982 | Pearl | 83/177 |
| 4,476,756 | 10/1984 | Pearl et al. | 83/422 |
| 4,527,346 | 7/1985 | Schwartzott | 83/100 X |
| 4,702,664 | 10/1987 | Lukens, Jr. | 83/451 X |
| 5,699,707 | 12/1997 | Campbell, Jr. | 83/100 |

*Primary Examiner*—Rinaldi I. Rada
*Assistant Examiner*—Ana Luna

[57] ABSTRACT

A waterjet cutting head for cutting a moving sheet has a base plate and a cover plate positioned over the base plate. The cover plate includes an upper support surface for supporting the sheet and has depending chamfered sidewalls extending downwardly to the base plate to define a chamber. The upper support surface includes two matrix arrays of circular shaped suction apertures through which air is drawn by a fluid motor to draw the sheet into flat engagement with and over the upper support surface. A waterjet emitting aperture is located in the upper support surface between an upstream suction aperture and a downstream suction aperture in a first general direction relative to sheet travel. A waterjet nozzle is positioned in the chamber below the waterjet emitting aperture for directing a waterjet through this aperture to cut through the sheet. The upstream aperture is positioned partially offset in a direction orthogonal to the first general direction relative to the downstream suction aperture. The waterjet emitting aperture is aligned with a portion of the upstream suction aperture in the first general direction and is offset from the downstream suction aperture in a direction orthogonal to the first general direction. Consequently, the sheet is drawn by the upstream aperture over the waterjet is cut and only an uncut portion of the sheet is supported by the downstream aperture.

16 Claims, 4 Drawing Sheets

WATERJET CUTTING HEAD

FIELD OF THE INVENTION

The present invention relates to a waterjet cutting apparatus and, in particular, to a water et cutting head for cutting a moving sheet or web.

BACKGROUND OF THE INVENTION

In the papermaking industry, knives or waterjets are commonly employed to cut through the traveling web or sheet. The knives and waterjets are used in edge trimming, slicing, cross-cutting, and tail cutting applications within the papermaking machine.

Waterjet cutting heads used in the papermaking industry typically include a base plate having a cover plate defining a chamber. The cover plate has one large upstream circular aperture through which air is drawn to hold the sheet against the cover plate. A second circular aperture is located downstream in the direction of sheet travel relative to the first circular aperture. A waterjet is emitted through the second aperture to cut the sheet. Air is drawn through the first aperture into a hose contained in the chamber. The hose passes through the base plate to remove the air from the chamber and maintain a vacuum. While such a described waterjet cutting head has good cutting performance characteristics, the cutting head does not provide support to the sheet downstream from the waterjet cutting nozzle in the direction of sheet travel.

There is a need for a waterjet cutting apparatus that has the ability to effectively cut through a sheet using a waterjet and thereafter discriminately support only that portion of the sheet to be further processed within the papermaking machine or the sheet processing machine.

SUMMARY OF THE INVENTION

The present invention relates to a waterjet cutting apparatus, particularly a waterjet cutting head, suitable for use in the papermaking industry that supports the sheet immediately prior to cutting and continues, immediately after cutting, to discriminately support a preselected portion of a papermaking sheet while discarding the trimmed or cut away portion of the sheet. The waterjet cutting head of the present invention has an upper or outer support surface for supporting the sheet for relative movement in a first general direction. The sheet is held in contact with the upper support surface by a series or plurality of apertures spaced over the upper support surface. A suction or back pressure is applied to the apertures to draw the sheet against the upper support surface. The upper support surface further includes an aperture sized to allow a jet of water to pass through the upper support surface and cut through the sheet. The arrangement of at least one suction aperture located immediately upstream of the waterjet aperture and the positioning of at least one aperture located downstream of the waterjet aperture provides for the discriminating support feature of the present invention. This is achieved by positioning the waterjet aperture in alignment with at least a portion of the upstream suction aperture in the first general direction of sheet movement. The upstream aperture and waterjet aperture are both positioned laterally offset from the downstream suction aperture in a direction orthogonal to the first general direction. Consequently, the paper or sheet is held over the waterjet cutting aperture by the upstream aperture, and after cutting of the sheet, the downstream suction aperture continues to support a portion of the sheet.

It should be understood that the shape of the apertures may be any shape that permits the sheet to be held in supporting engagement with the upper support surface. Further, the size of the apertures are chosen corresponding to the amount of suction applied through the apertures so as to maintain the sheet in engagement with the upper support surface. In a preferred aspect of the present invention, the apertures are circular in shape. Preferably, apertures located upstream of the waterjet aperture are positioned in a first spaced matrix array of apertures and the apertures located downstream of the waterjet aperture are position in a second spaced matrix array of apertures. The first spaced matrix array of apertures are collectively offset in the orthogonal direction relative to be second spaced matrix array of apertures.

In accordance with a broad aspect of the present invention there is provided a waterjet cutting apparatus for cutting through a moving sheet comprising an upper sheet support surface for supporting the sheet for relative movement therewith in a first general direction. The apparatus includes a first suction aperture and a second suction aperture located on the upper support surface providing fluid flow passages through the upper support surface. The first suction aperture is located upstream in the first general direction of movement from the second suction aperture. The first suction aperture is at least partially offset from the second suction aperture in a direction orthogonal to the first general direction. The apparatus includes a fluid motor located below the upper support surface in fluid communication with the fluid flow passages for creating a flow of fluid through the first and second apertures that draws the sheet into supporting contact with the upper support surface. The apparatus includes a third aperture located on the upper support surface passing through the upper support surface. The third aperture is located downstream of the first suction aperture and upstream of the second suction aperture in the first general direction. The third aperture is aligned with at least a portion of the first suction aperture in the first general direction and the third aperture is offset from the second suction aperture in a direction orthogonal to the first general direction. The apparatus further includes a waterjet nozzle positioned below the upper support surface adjacent the third aperture for directing a waterjet through the third aperture to cut through the sheet.

BRIEF DESCRIPTION OF THE DRAWINGS

For a better understanding of the nature and objects of the present invention reference may be had to the accompanying diagrammatic drawings in which.

DETAILED DESCRIPTION OF THE DRAWINGS

Figure 1:
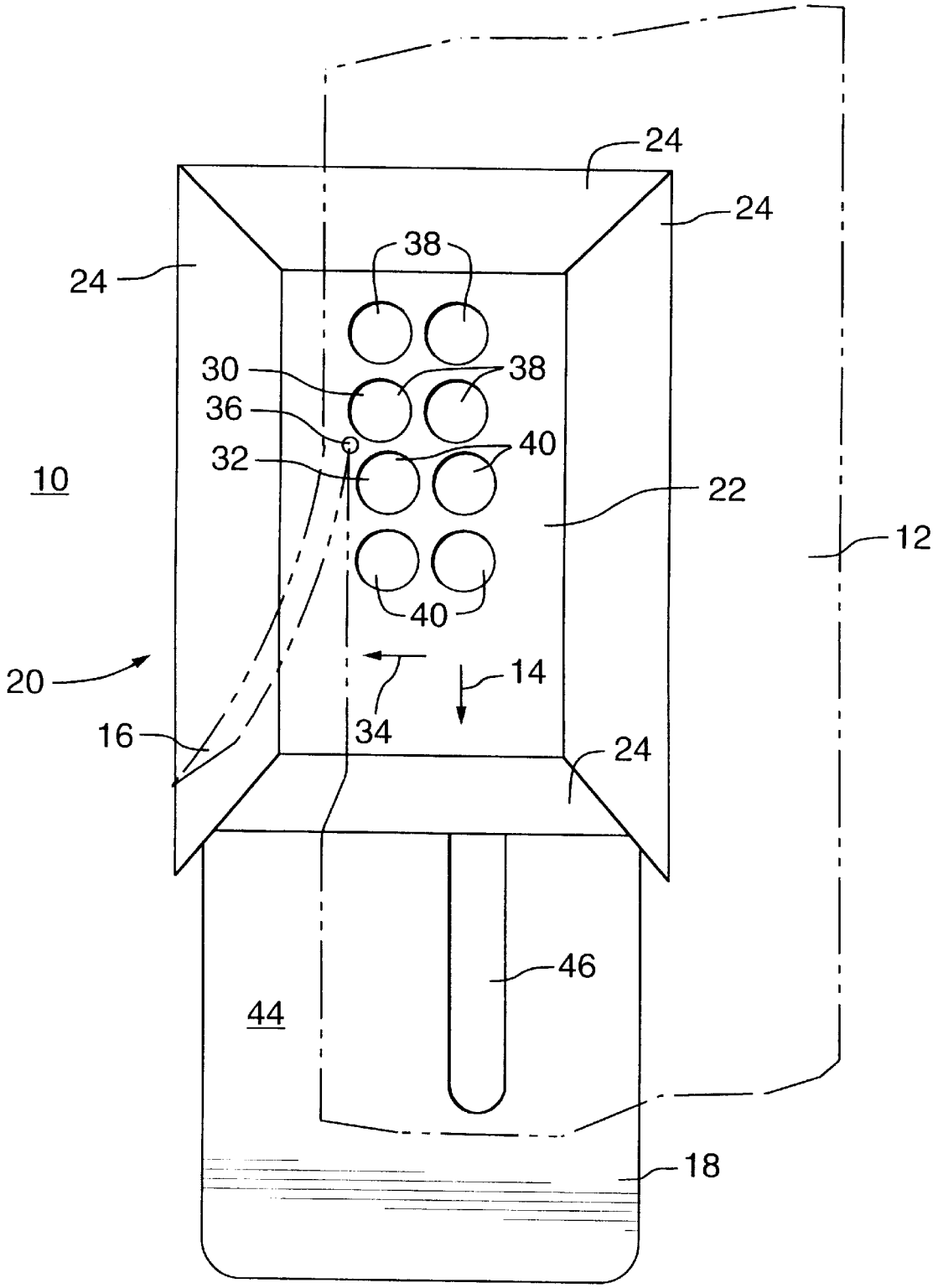
FIG. 1 is a plan view showing the waterjet cutting head of the present invention.

Referring to the drawings and, in particular FIG. 1, a waterjet cutting head 10 supports a sheet 12. The sheet 12 moves relative to the cutting head 10 in the first general direction depicted by arrow 14. As the sheet 12 moves in the direction of arrow 14, the cutting head 10 cuts a trim portion 16 of the sheet 12. The trim portion 16 is discarded while the remainder of the sheet 12 is supported by the cutting head 10. It should be understood that the cutting head 10 may be movable relative to the sheet 12 in directions different from that shown by arrow 14 so that the cutting head 10 performs different cutting functions. These functions include, for example, tail cutting, cross-cutting, edge trimming, and slicing.

Referring to all the drawings, the cutting head 10 includes a base plate 18 and a cover plate 20. The cover plate 20 includes an upper support or outer surface 22 for supporting the sheet 12. The cover plate further includes sloping sidewalls 24 extending downwardly or rearwardly from the upper support surface 22 to the base plate 18 to define a chamber 26. One of the sidewalls 24 in the downstream side of the cover plate 20 provides an air flow exit aperture 28 (see FIGS. 2 and 4) which comprises a space located between this one sidewall 24 and the base plate 18.

The sidewalls 24 of the cover plate are chamfered or angled to allow for the movement of the edges of the sheet 12 to move up the sidewalls 24 and be pulled into engagement with the upper support surface 22 as the head 10 is moved into cutting relation with the sheet 12.

Figure 2:
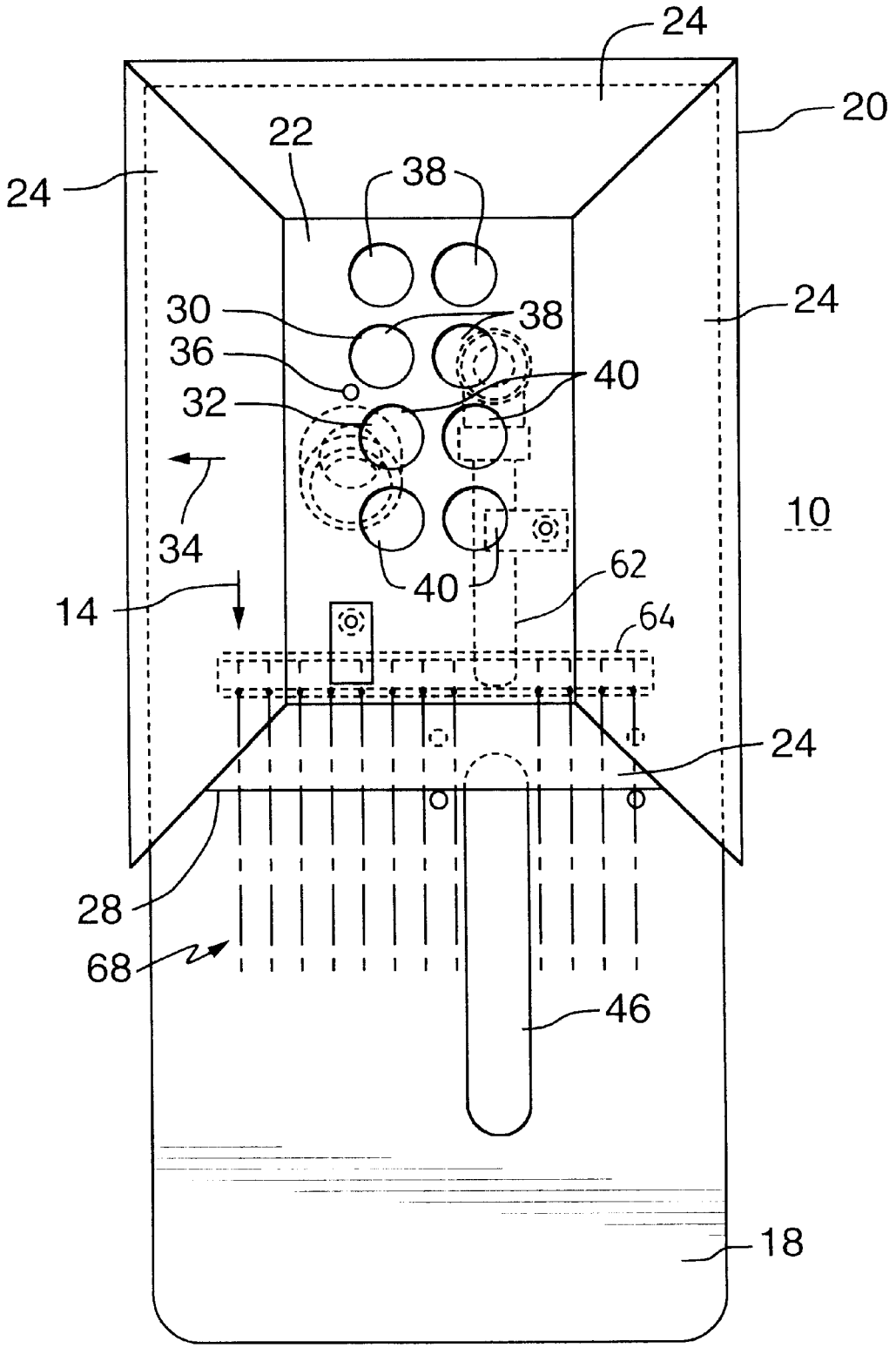
FIG. 2 is a top sectional view showing the waterjet cutting head of the present invention.

Referring to FIGS. 1 and 2, the upper support surface 22 includes a first suction aperture 30 and a second suction aperture 32 that provide fluid flow passages through the upper support surface 22. The first suction aperture 30 is located upstream in the first general direction 14 relative to the second suction aperture 32. The first suction aperture 30 is at least partially offset from the second suction aperture 32 in a direction depicted by arrow 34 which direction is orthogonal to the first general direction shown by arrow 14.

A third cutting aperture 36 is located in the upper support surface 22 and passes through the upper support surface 22. The third aperture 36 is positioned downstream of the first suction aperture 30 and upstream of the second suction aperture 32. The third aperture 36 is aligned in the first general direction 14 with at least a portion of the first suction aperture 30. The third aperture 36 is further positioned offset in the orthogonal direction of arrow 34 relative to the second suction aperture 32 and is out of alignment in the direction of arrow 14 with the second suction aperture. This relative alignment of the first suction aperture 30, the second suction aperture 32 and the third aperture 36 draws the sheet 12 into engagement with the upper flat support surface 22 such that an edge or point on the sheet 12 passes over the third cutting aperture 36 through which a waterjet 37 is emitted to cut the sheet 12. It should be understood that the cutting head 10 can be moved laterally into cutting engagement relative to the sheet 12 to effect the commencement of a diagonal cross cut in the sheet 12 and maintain either a slice or, a tail, continuing to move in a lateral direction to cut across the sheet 12.

To facilitate the holding of sheet 12 against the upper support surface 22, a series of circular apertures similar to apertures 30 and 32 are shown in FIGS. 1 and 2. The first suction aperture 32 is shown to be one aperture of a group of matrix array of apertures 38. The second suction aperture 34 is shown to be one aperture of a matrix array of apertures 40. The matrix array of apertures 38 are offset in the orthogonal direction shown by arrow 34 relative to the second matrix array of apertures 40. This allows the sheet 12 moving downstream of the third cutting aperture 36 to be continuously supported by the cutting head 10 against surface 22 while allowing the cut away strip 16 of the sheet 12 to be discarded.

Figure 3:
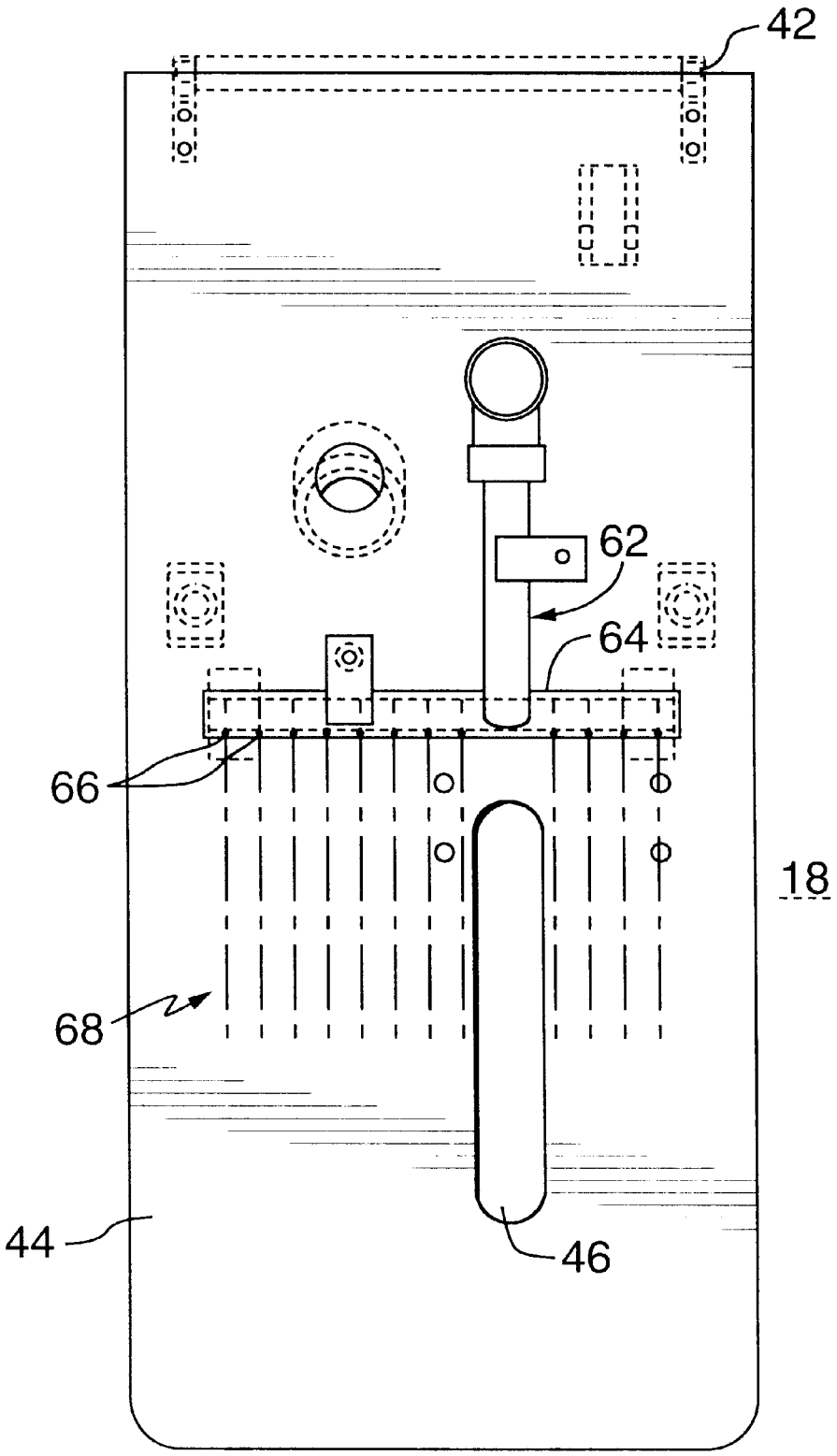
FIG. 3 is a plan view showing the base plate of the waterjet cutting head with the cover plate removed.
Figure 4:
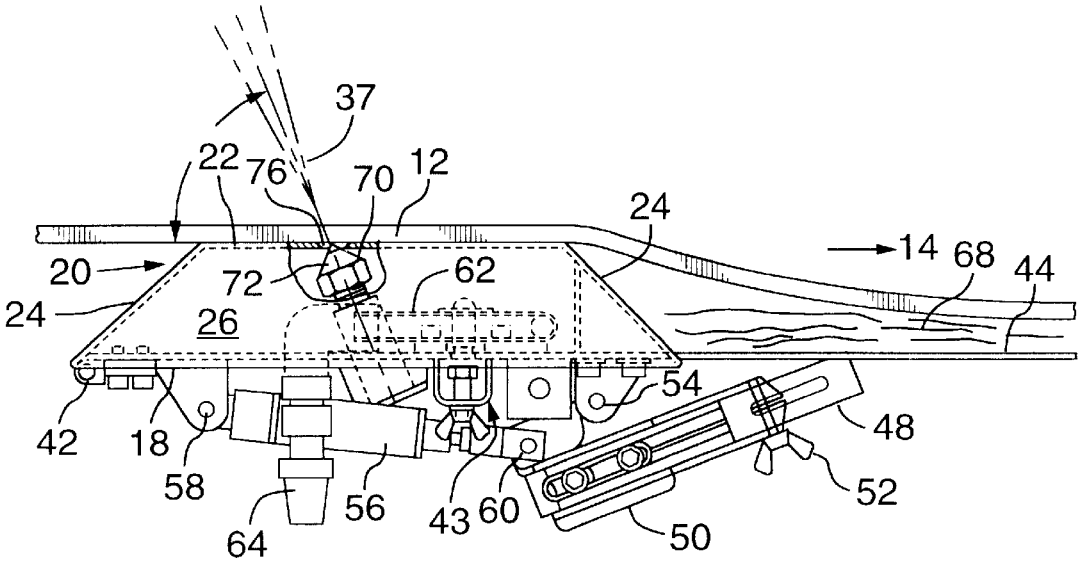
FIG. 4 is a side sectional view of the waterjet cutting head of the present invention showing the cutting knife blade in a retracted position.
Figure 5:
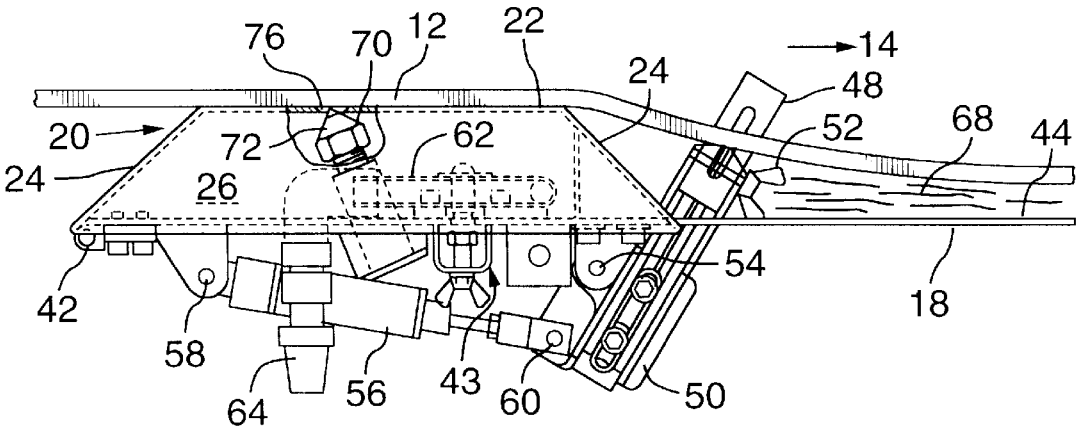
FIG. 5 is a side sectional view of the waterjet cutting head of the present invention showing the cutting knife blade in an extended position; and, FIG. 6 is a partial rear end view of the waterjet cutting head of the present invention.
Figure 6:
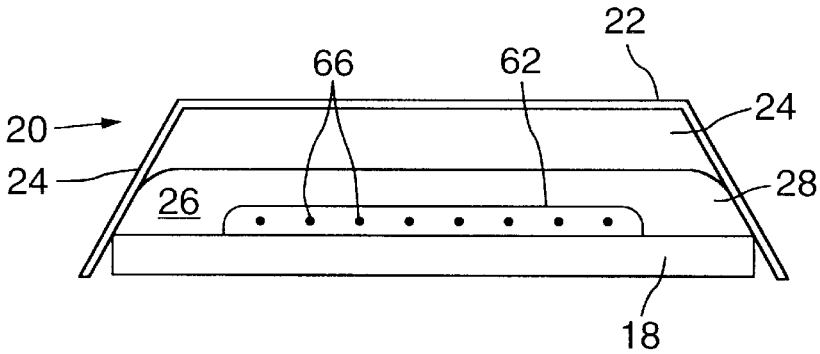

Referring to FIG. 4, the cover plate 20 is pivoted or hinged at pivot support 42 to the base plate 18. This allows the cover plate 20 to be swung open to service parts mounted to the base plate 18. The cover plate is held during normal operation against base plate 18 by the wing nut and bracket arrangement shown generally at 43. The base plate 18 is positioned below the cover plate 20 and has an exposed base plate extension portion 44 in the downstream direction 14 that further supports the sheet 12. The exposed base plate portion 44 includes an elongate slot 46 through which an auxiliary cutting knife blade 48 is adapted to pass. The cutting knife blade 48 is adjustable relative to the blade holder 50 by means of wing screw 52. The cutting knife holder 50 is pivotally mounted to the base plate 18 at pivot 54. Blade holder 50 is rotated about pivot 54 by pneumatic piston 56 having its cylinder pivotally mounted at 58 to the base plate 18 and having its head pivotally mounted to the cutting blade holder 50 at point 60. In the event the waterjet 37 fails to function, then be blade 48 is moved into the cutting position shown in FIG. 3. Alternatively, an auxiliary waterjet cutter can be employed by the suction head.

The suction pressure through the apertures 38 and 40 and into the chamber 26 is established by fluid motor 62 located behind supporting surface 22 in the chamber 26. Fluid motor 62 comprises a fluid conduit 64 passing through the base plate 18. The conduit forms a T shaped fluid conduit head having a plurality of jets 66 (see FIG. 4) for directing air or fluid towards the air flow exit aperture 28. This also creates the air stream 68 passing over the exposed surface 44 of the base plate. This air stream 68 has the benefit of providing an air curtain over which the sheet 12 continues to follow after leaving or moving beyond the upper support surface 22 of the cover plate 20. Thus, a Coanda effect is established by the air flow 68 in conjunction with the exposed base plate portion 44. Another benefit of the air stream 68 is to establish a guide for tail 16 to be forwarded by air flow 68 to a nip point downstream of plate 18.

The waterjet cutting head 10 further includes a waterjet nozzle 70 positioned below the upper support surface 22 inside the chamber 26. The waterjet nozzle 70 has a nut head 72 positioned in close adjacent relation to the third aperture 36 so as to emit a coherent jet 37 of water through the sheet 12. The waterjet 70 has a conduit that passes through the base plate 18 for supplying pressurized water. The third aperture 36 has a conical shaped bore 76 against which the nut head 72 of the waterjet 70 is positioned so as to keep the jet 37 as close to the sheet 12 as possible to optimize the cutting efficiency of the waterjet.

It should be understood that alternative embodiments of the present invention may be readily apparent to a man skilled in the art in view of the above description for the preferred embodiments of this invention. Accordingly, the scope of the present invention should not be limited to the teachings of the preferred embodiments and should be limited to the scope of the claims that follow.

What is claimed is:

1. A waterjet cutting apparatus for cutting through a moving sheet comprising:

a support member having a base plate and a cover plate positioned over the base plate, the cover plate including an outer support surface for supporting the sheet for relative movement therewith in a first general direction and having sidewalls extending rearwardly to the base plate to define a chamber, and one sidewall of the sidewalls having at least one air flow exit aperture permitting air to flow out of the chamber;

the cover plate having a first suction aperture and a second suction aperture located on the support surface providing fluid flow passages through the support surface, the first suction aperture being located upstream in the first general direction of movement from the second suction aperture the first suction aperture being at least partially offset from the second suction aperture in a direction orthogonal to the first general direction;

a fluid motor located behind the support surface in fluid communication with the fluid flow passages for creating a flow of fluid through the first and second apertures that draws the sheet into supporting contact with the upper support surface;

the cover plate having a third aperture located on the support surface passing through the support surface, the third aperture located downstream of the first suction aperture and upstream of the second suction aperture in the first general direction, the third aperture being aligned with at least a portion of the first suction aperture in the first general direction and the third aperture being offset from the second suction aperture in a direction orthogonal to the first general direction; and, a waterjet nozzle positioned behind the support surface adjacent the third aperture for directing a waterjet through the third aperture to cut through the sheet.

2. The waterjet cutting apparatus of claim 1 further comprising a plurality of additional suction apertures, the first, second and additional suction apertures having a circular shape and being distributed in spaced apart relation over the upper support surface.

3. The waterjet cutting apparatus of claim 1, wherein the first suction aperture comprises one of a first group of suction apertures positioned on the support surface in a spaced apart first matrix array, and the second suction aperture comprises one of a second group of apertures positioned on the support surface in a spaced apart second matrix array.

4. The waterjet cutting apparatus of claim 1, wherein first group of suction apertures in the first matrix array are at least partially offset from the second group of suction apertures in the second matrix array in the direction orthogonal to the first general direction.

5. The waterjet cutting apparatus of claim 1 wherein the fluid motor is located within the chamber to draw air into the chamber through the first and second suction apertures and force the air to leave the chamber through the at least one air flow exit aperture.

6. The waterjet cutting apparatus of claim 5 wherein the fluid motor comprises an air conduit passing through the base plate, the air conduit having at least one nozzle opening facing toward the at least one air flow exit aperture.

7. The waterjet cutting apparatus of claim 5 wherein the fluid motor comprises an air conduit passing through the base plate, the air conduit having a T shape with a top leg of the T shape conduit having a plurality of jets facing toward at least one air flow exit aperture.

8. The waterjet cutting apparatus of claim 5 wherein the one sidewall is located on the downstream side of the cover plate in the direction of sheet travel, and the air flow exit aperture comprises a space located between the one sidewall and the base plate.

9. The waterjet cutting apparatus of claim 7 wherein the one sidewall is located on the downstream side of the cover plate in the direction of sheet travel, and the air flow exit aperture comprises a space located between the one sidewall and the base plate.

10. The waterjet cutting apparatus of claim 1 wherein the waterjet nozzle is located in the chamber directly beneath the third aperture.

11. The waterjet cutting apparatus of claim 10 wherein the waterjet nozzle is connected to a water supply conduit passing through the base plate.

12. The waterjet cutting apparatus of claim 1 wherein cover plate is hinged to the base plate.

13. The waterjet cutting apparatus of claim 1 wherein the base plate extends in the direction of sheet travel a greater distance than the cover plate to leave an exposed base plate portion, the exposed base plate portion including an elongate slot, the waterjet cutting apparatus further including an auxiliary cutting knife pivotally connected to the base plate on a side thereof opposite to the cover plate, the cutting knife being movable between a recessed position where a blade of the knife is positioned below the base plate and an extended position where the blade of the cutting knife extends through the elongate slot for cutting engagement with the sheet.

14. The waterjet cutting apparatus of claim 5 wherein the cover plate below the third aperture has a conical shaped bore against which a head for the waterjet nozzle is positioned.

15. The waterjet cutting apparatus of claim 1 wherein the base plate extends in the direction of sheet travel a greater distance than the cover plate to leave an exposed base plate portion to function as a guide plate for a severed sheet portion.

16. The waterjet cutting apparatus of claim 1 wherein the sidewalls are sloped downwardly and outwardly of the cover plate to provide a chamfered surfaces about the upper support surface.

* * * * *

UNITED STATES PATENT AND TRADEMARK OFFICE

CERTIFICATE OF CORRECTION

PATENT NO. : 6,021,699

DATED : February 8, 2000

INVENTOR(S) : CASPAR

It is certified that error appears in the above-identified patent and that said Letters Patent is hereby corrected as shown below:

Claim 14, line 1, change "5" to --1--.

Signed and Sealed this

Thirteenth Day of February, 2001

*Attest:*

Nicholas P. Godici

NICHOLAS P. GODICI

*Attesting Officer*

*Acting Director of the United States Patent and Trademark Office*